US007059493B2

(12) United States Patent
Welchel et al.

(10) Patent No.: US 7,059,493 B2
(45) Date of Patent: Jun. 13, 2006

(54) DISPENSER FOR WET AND DRY INTERFOLDED TISSUE

(75) Inventors: Debra N. Welchel, Woodstock, GA (US); Joseph Mitchell, Alpharetta, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 190 days.

(21) Appl. No.: 10/304,570

(22) Filed: Nov. 26, 2002

(65) Prior Publication Data

US 2004/0099679 A1 May 27, 2004

(51) Int. Cl.
*B65H 1/00* (2006.01)

(52) U.S. Cl. ..... 221/34; 221/35; 221/48; 221/130

(58) Field of Classification Search ..... 221/34, 221/35, 48, 47, 45, 130
See application file for complete search history.

(56) References Cited

U.S. PATENT DOCUMENTS

| | | | | |
|---|---|---|---|---|
| 2,122,048 | A | 6/1938 | Shapiro | |
| 2,738,898 | A * | 3/1956 | Lee | 221/35 |
| 2,765,909 | A | 10/1956 | Graham | |
| 3,089,583 | A * | 5/1963 | White | 206/233 |
| 3,459,329 | A * | 8/1969 | Mochizuki | 221/34 |
| 3,824,953 | A | 7/1974 | Boone | |
| 3,836,044 | A | 9/1974 | Tilp et al. | |
| 3,837,595 | A | 9/1974 | Boone | |
| 3,921,802 | A | 11/1975 | Thompson | |
| 3,986,479 | A * | 10/1976 | Bonk | 118/506 |
| 3,994,417 | A * | 11/1976 | Boedecker | 221/48 |
| 3,995,582 | A | 12/1976 | Douglas | |
| 4,106,616 | A | 8/1978 | Boone | |
| 4,106,617 | A | 8/1978 | Boone | |
| 4,235,333 | A | 11/1980 | Boone | |
| 4,478,354 | A * | 10/1984 | Notheis | 221/34 |
| 4,610,357 | A | 9/1986 | Nakamura | |
| 4,620,502 | A | 11/1986 | Kimble | |
| 4,638,921 | A * | 1/1987 | Sigl et al. | 221/1 |
| 4,651,871 | A | 3/1987 | Schroter | |
| 4,653,256 | A | 3/1987 | Saiia | |
| 4,739,879 | A | 4/1988 | Nakamura | |
| 4,834,316 | A | 5/1989 | Delorean | |
| 4,913,312 | A | 4/1990 | Boutin | |
| 4,953,747 | A * | 9/1990 | Wenkman et al. | 221/45 |
| 5,265,758 | A | 11/1993 | Saint Criq et al. | |
| 5,311,986 | A * | 5/1994 | Putz | 206/233 |

(Continued)

FOREIGN PATENT DOCUMENTS

CA 2305110 10/2001

(Continued)

OTHER PUBLICATIONS

PCT Search Report Nov. 12, 2003.

*Primary Examiner*—David H. Bollinger
(74) *Attorney, Agent, or Firm*—Dority & Manning

(57) ABSTRACT

A dispenser is provided for simultaneously storing and dispensing premoistened tissue sheets and dry tissue sheets. The dispenser includes a housing having a compartment configured to retain a supply of dry tissue sheets, and a liquid impermeable compartment configured to retain a supply of premoistened tissue sheets. A dispensing opening is defined in each of the compartments. A support mechanism is disposed on an exterior surface of the housing. The support mechanism engages with a roll product support fixture such that the housing is supported by a single fixture and consumers are presented with premoistened and dry tissue sheets from a single housing supported from a single fixture.

22 Claims, 4 Drawing Sheets

U.S. PATENT DOCUMENTS

| | | | | |
|---|---|---|---|---|
| 5,409,181 | A | 4/1995 | Patrick | |
| 5,439,521 | A | 8/1995 | Rao | |
| 5,618,008 | A | 4/1997 | Dearwester et al. | |
| 5,660,636 | A | 8/1997 | Shangold et al. | |
| 5,765,717 | A | 6/1998 | Gottselig | |
| 5,897,074 | A | 4/1999 | Marino | |
| 5,950,960 | A | 9/1999 | Marino | |
| 5,951,762 | A | 9/1999 | Shangold et al. | |
| 6,047,920 | A | 4/2000 | Dearwester et al. | |
| 6,056,235 | A * | 5/2000 | Brozinsky | 242/598.6 |
| 6,098,836 | A | 8/2000 | Gottselig | |
| 6,170,698 | B1 | 1/2001 | Phelps et al. | |
| 6,230,929 | B1 | 5/2001 | Phelps et al. | |
| 6,346,153 | B1 | 2/2002 | Lake et al. | |
| 6,382,552 | B1 | 5/2002 | Paul et al. | |
| 6,439,386 | B1 | 8/2002 | Sauer et al. | |
| 6,554,156 | B1 * | 4/2003 | Chong | 221/63 |
| 2002/0162847 | A1 * | 11/2002 | Roy | 221/34 |
| 2003/0075551 | A1 * | 4/2003 | Dailey | 221/45 |

FOREIGN PATENT DOCUMENTS

| | | | |
|---|---|---|---|
| EP | 1129656 | A1 | 9/2001 |
| WO | 9414365 | | 7/1994 |
| WO | 9804486 | | 2/1998 |
| WO | 0065973 | A1 | 11/2000 |
| WO | 0153168 | A1 | 7/2001 |
| WO | 0164525 | A2 | 9/2001 |
| WO | 0176436 | A1 | 10/2001 |
| WO | 0176440 | A1 | 10/2001 |
| WO | 0189935 | A2 | 11/2001 |
| WO | 0221988 | A1 | 3/2002 |
| WO | 0221989 | A2 | 3/2002 |

* cited by examiner

DISPENSER FOR WET AND DRY INTERFOLDED TISSUE

TECHNICAL FIELD

The present invention relates generally to the filed of folded sheet dispensers.

BACKGROUND

The use of premoistened or "wet" tissues or towel sheets has gained wide acceptance for a variety of uses, particularly premoistened bathroom tissue applications. The premoistened sheets are generally formed from an absorbent material such as tissue paper or a polymeric nonwoven web, and may contain a disinfectant, medicant, deodorant, cleansing agent, etc., in the "wet" formulation. The sheets are generally stored and dispensed from a sealable container to prevent the sheets from drying out.

Various premoistened tissue dispenser designs have been proposed for use with existing bathroom fixtures, such as fixtures for conventional rolled tissue products. For example, reference is made to U.S. Pat Nos. 5,439,521; 5,897,074; 6,056,235, and WO 01/89935. Such dispensers are designed to convert or adapt the premoistened tissue sheet dispenser to operate with the dry rolled tissue dispenser fixture. However, in doing so, the dry tissue roll is displaced from its dispenser. In other words, if the premoistened tissues are to be dispensed from the fixture, the conventional dry tissues cannot be dispensed. In reality, however, uses exist in a bathroom, restroom, and the like, for both wet and dry tissues. Thus, to satisfy this need with conventional designs, separate fixtures would need to be provided for wet and dry tissue dispensers. This may be problematic for space and mounting considerations, and it may not be possible or desirable to separately mount two different dispenser fixtures.

Accordingly, it would be desirable to provide a dispenser capable of dispensing wet and dry tissues simultaneously from a common fixture. The present invention addresses this need.

SUMMARY

Objects and advantages of the invention will be set forth in part in the following description, or may be obvious from the description, or may be learned through practice of the invention.

The present invention provides a unique dispenser configured for simultaneously dispensing premoistened and dry tissues from a single dispenser fixture. The dispenser includes a housing having a first compartment configured to retain a supply of dry tissue sheets, and a second liquid impermeable compartment configured to retain a supply of premoistened tissue sheets. A dispensing opening is defined in each of the first and second compartments.

A support mechanism is disposed on an exterior surface of the housing, for example on side walls of one of the compartments. The support mechanism is engageable with a dispenser fixture such that the housing is supported by a single fixture and consumers are presented with premoistened and dry tissue sheets from a single housing supported from a single fixture. In a more particular embodiment, the fixture is a conventional rolled bathroom tissue dispenser having a base and laterally extending support arms. The support arms include a recess or divot defined on the inner facing surfaces thereof into which the ends of a spindle are received. The spindle is typically inserted through a core or hollow member provided in the bathroom tissue roll.

The support members of the present dispenser may thus include relatively simple protruding members provided on side walls of the dispenser, the protruding members having a size so as to be received within the fixture support arm recesses. The protruding members may be spring loaded. Thus, the dispenser housing may have a width and a depth so as to fit between the support arms of a conventional rolled product dispenser fixture and to be engaged and supported by the recesses provided in such support arms.

It should be appreciated that the housing is not limited to any particular style, configuration, or shape, and may take on any aesthetically pleasing configuration and be made of any conventional material. It should also be appreciated that the dispenser according to the invention is not limited to any particular type of premoistened or dry tissue sheets. For example, in one embodiment, the premoistened tissue sheets and dry tissue sheets are in the form of stacked interfolded sheets. The first and second compartments would thus have a size and configuration for retaining a stack of such interfolded sheets.

In one embodiment, the housing is an integral unit wherein the first and second compartments are defined within a single housing component. In this embodiment, the premoistened tissue sheet compartment may be disposed above the dry tissue compartment and the two compartments may share a common wall. For example, the bottom of the upper compartment may also define the top of the lower compartment.

In an alternate embodiment, the first compartment and the second compartment may be separable from each other. For example, the premoistened sheet compartment may be stacked above the dry tissue sheet compartment, and the two compartments may be frictionally engaged. For example, the bottom dry tissue sheet compartment may be frictionally engaged within a flanged skirt area defined along the bottom circumference of the premoistened tissue sheet compartment. The compartments are attached or joined together by pushing the bottom dry tissue sheet compartment into the upper premoistened tissue sheet compartment. The compartments may be separated merely by pulling the two compartments apart.

The premoistened tissue sheet compartment may include a resealable cover disposed over the dispensing opening to help retain moisture within the compartment.

It may be desired that at least one of the compartments is openable for refilling the compartment. For example, the premoistened tissue sheet compartment may have a lid wherein a stacked supply (e.g., a cartridge) of premoistened tissue sheets can be refilled into the compartment. Likewise, the dry tissue sheet compartment may also have an opening or access for refilling the compartment. In an alternative embodiment, the compartments are not refillable and the housing is a disposable member.

Aspects of the invention will be described in greater detail below by reference to embodiments illustrated in the figures.

DETAILED DESCRIPTION

Figure 1:
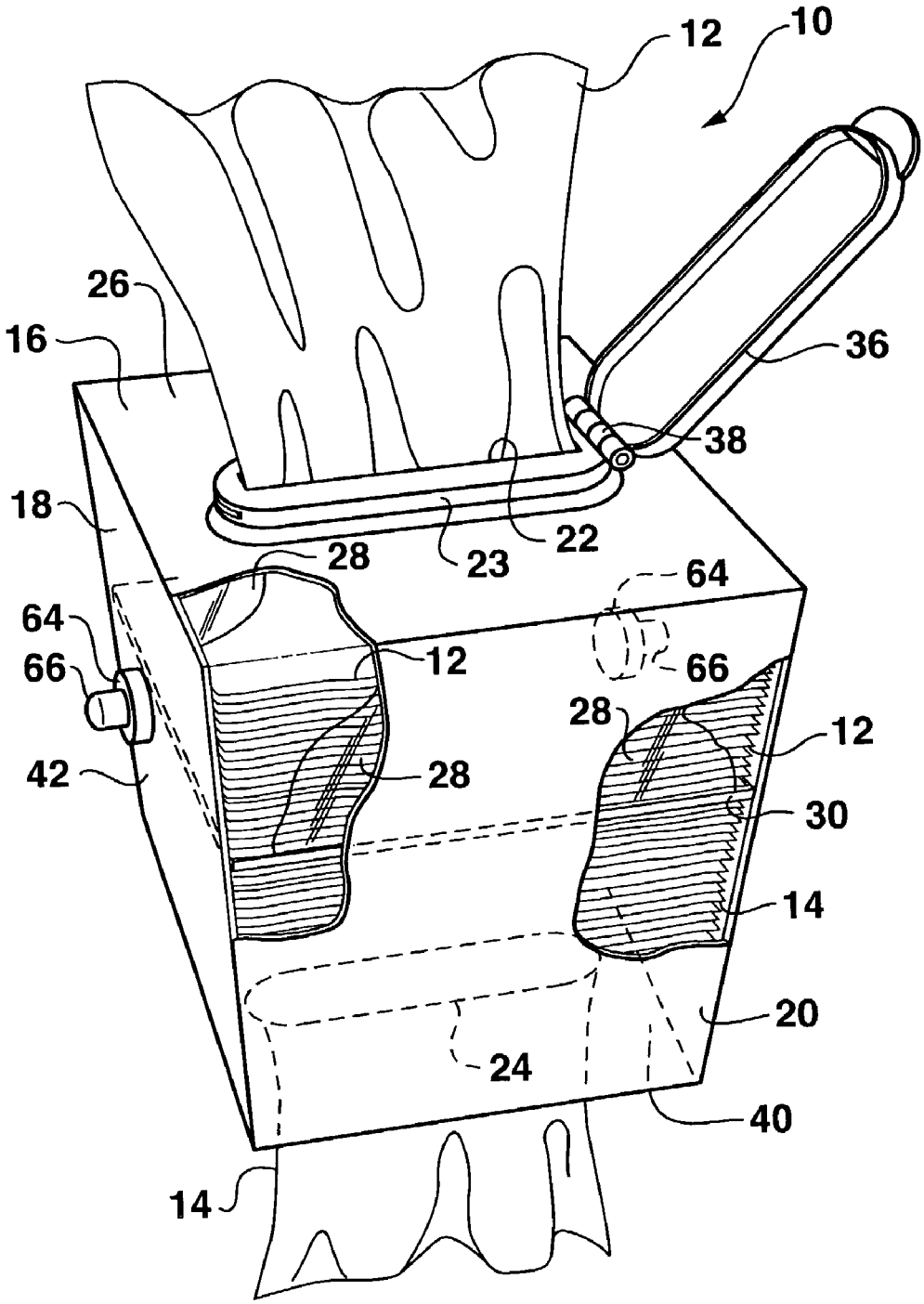
FIG. 1 is a perspective drawing of a dispenser in accordance with the invention with sections of the dispenser shown in partial cut-away.

Reference will now be made in detail to one or more embodiments of the invention, examples of which are illustrated in the drawings. Each example and embodiment are provided by way of explanation of the invention, and not meant as a limitation of the invention. For example, features illustrated or described as part of one embodiment may be used with another embodiment to yield still a further embodiment. It is intended that the invention include these and other modifications and variations as come within the scope and spirit of the invention.

Referring to the figures in general, a dispenser according to the invention is provided for storing and dispensing both premoistened tissue sheets and dry tissue sheets from a single dispenser housing. It should be appreciated that the invention is not limited to any particular type of dry or premoistened tissue sheets. The dispenser according to the invention is particularly well suited for dispensing individual stacked interfolded sheets, as generally illustrated in the figures. Such stacked configurations for dry or premoistened sheets are well known to those of ordinary skill in the art and need not be described in great detail herein.

A dispenser 10 according to the invention is provided for dispensing premoistened tissue sheets 12 and dry tissue sheets 14 from a single housing unit 16. The housing 16 includes a compartment 18 in which the premoistened tissue sheets 12 are stored and dispensed from, and a different compartment 20 in which the dry tissue sheets 14 are stored and dispensed from. A dispensing opening 22 is defined in the premoistened tissue sheet compartment 18, and a dispensing opening 24 is defined in the dry tissue sheet compartment 20. The dispensing openings may be defined in any wall structure of the respective compartments. For example, in the illustrated embodiment, the dispensing opening 22 in the premoistened tissue sheet compartment 18 is defined in a top surface or wall 26. The dispensing opening 24 in the dry tissue sheet compartment 20 is defined in a bottom wall or surface 40 of the compartment. It should also be appreciated that the dispensing openings 22 and 24 may take on any suitable shape or configuration.

Figure 3:
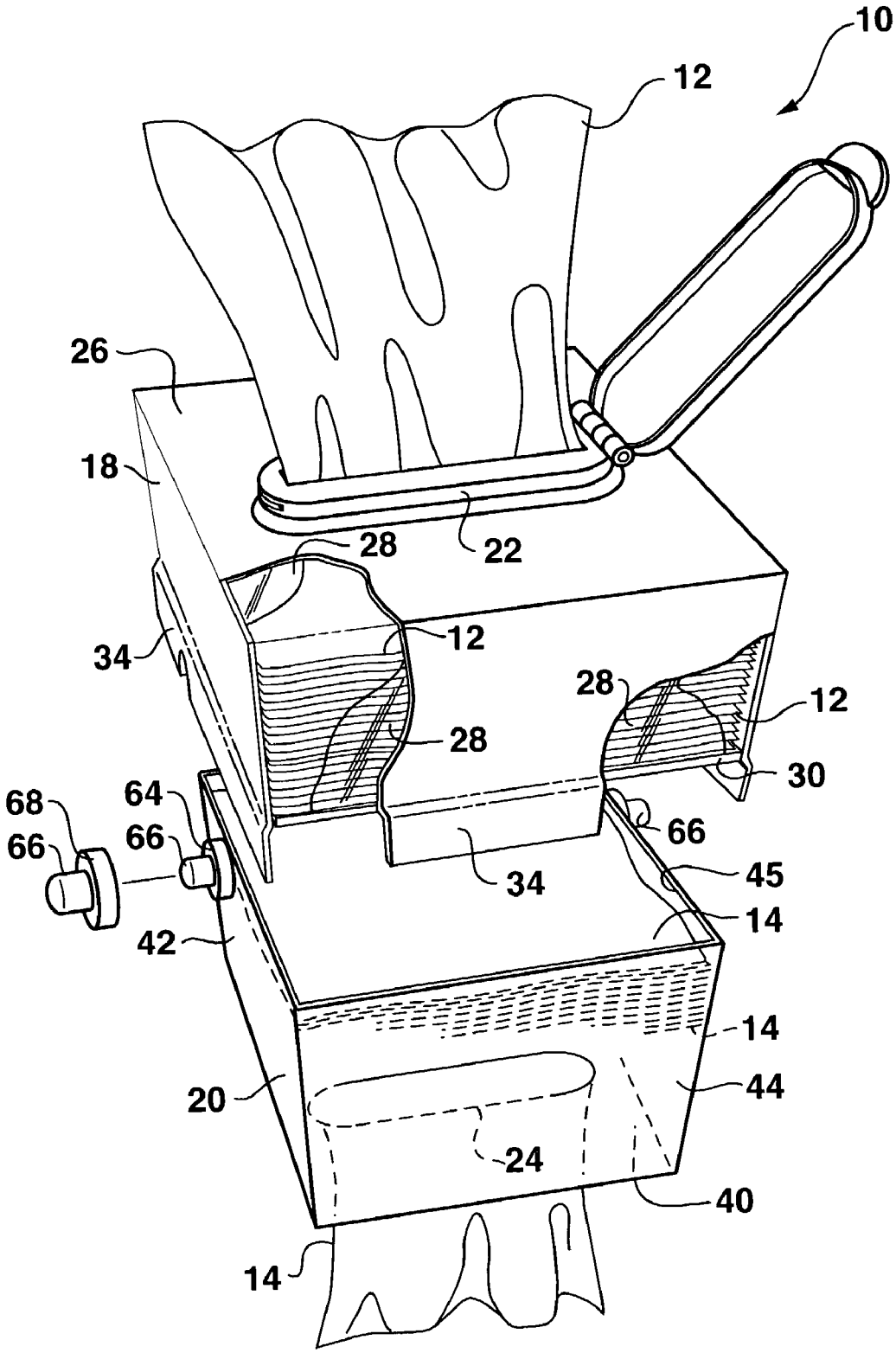
FIG. 3 is a conventional view of an alternative embodiment of the dispenser.

A support mechanism is disposed on an exterior surface of the housing 16. In the illustrated embodiment, the support mechanism 64 includes a protruding member 66 defined on opposite side walls 42 of the dispenser housing 16. The support mechanism 64 may be components that are formed integral with the side walls or, as illustrated in FIG. 3, may comprise an adapter 68 that is attached to the side walls. A suitable support or mounting mechanism is described in the copending U.S. Patent Application entitled "An Interfolded Tissue Sheet Dispenser with Adjustable Attaching Mechanism" filed concurrently with this application and having a serial number of [to be supplied].

Figure 2:
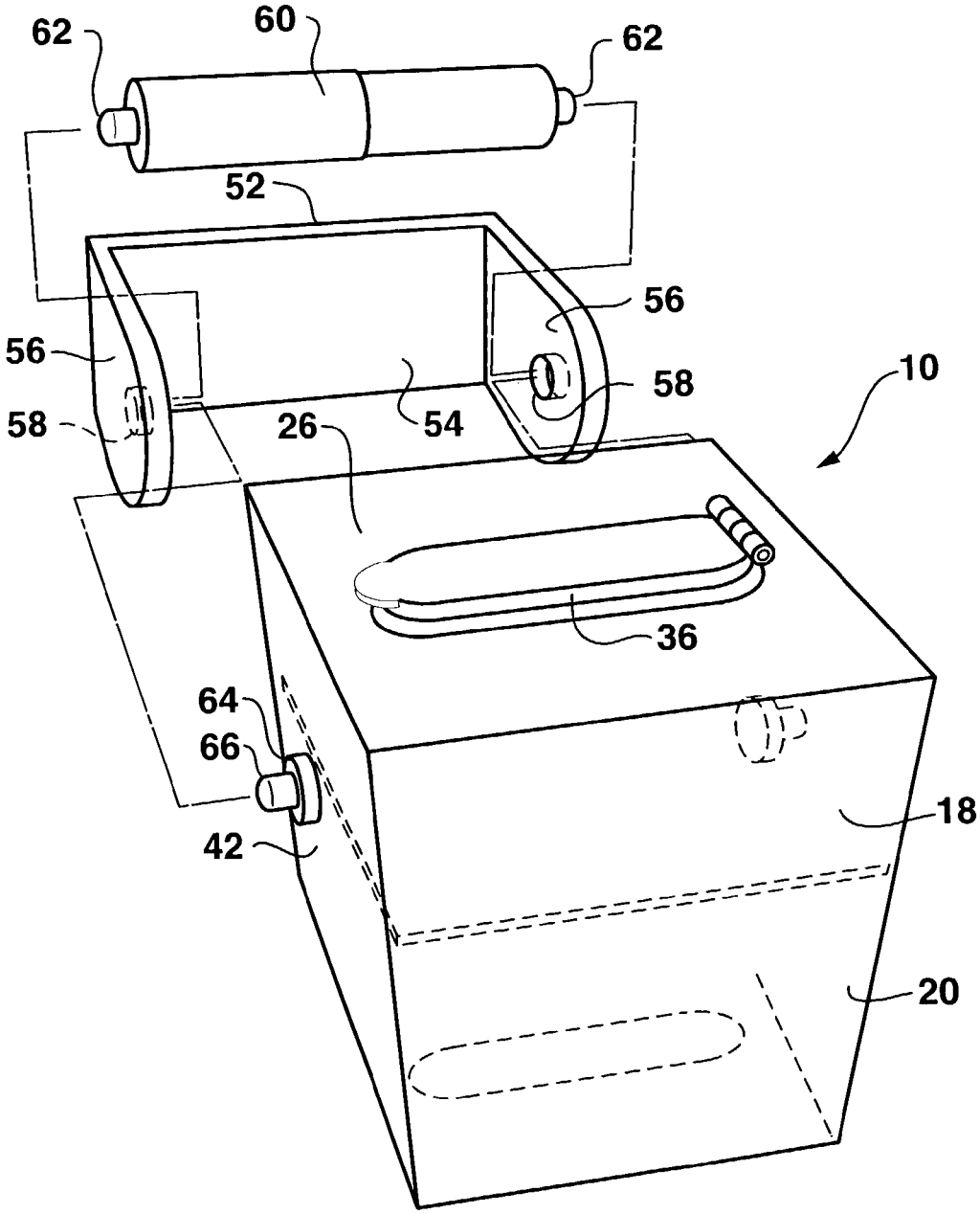
FIG. 2 is a perspective view of a dispenser in accordance with the invention particularly illustrating engagement of the dispenser with a conventional rolled product fixture.

Referring particularly to FIG. 2, the housing 16 has a configuration with a width and a depth so as to be supported by a conventional roll product fixture. Such fixtures are well known and a typical fixture 52 is illustrated in FIG. 2 as having a base or back member 54 and transversely extending side support arms 56. Each of the support arms 56 typically includes a recess or divot 58 formed therein. A conventional spindle 60 having protruding members 62 on each end is typically inserted through a hollow core of a roll product and received in the recesses 58. As indicated by the dashed lines in FIG. 2, the dispenser 10 according to the invention in one particular embodiment is designed to be engaged by such typical fixture 52 utilized for rolled products. The support mechanism 64 on each of the side walls 42 of the dispenser housing 16 includes the protruding member 66, which may be a spring loaded member, that engages in a respective recess 58 in the fixture side arm 56. Once the protruding members 66 are engaged within the recesses 58, the dispenser 10 is prevented from rotating or pivoting by the fact that the back wall of the dispenser 10 abuts against the base 54 of the fixture 52.

The housing 16 may be formed of any conventional material, and may be a relatively inexpensive plastic disposable material, paperboard material, paper, cardboard, and the like. In the embodiment illustrated in FIG. 1, the housing is an integral unit such that the compartments 18 and 20 are joined and non-separable. For example, the housing 16 may contain an internal wall 30. This wall 30 may define the bottom of the premoistened tissue compartment 18 as well as the top of the dry tissue compartment 20. It may be desired to form the housing 16 of a liquid impermeable material so as to properly contain the premoistened tissue sheets 12. However, the housing 16 may be formed of any type of material, including a liquid absorbent or liquid permeable material. In this case, the premoistened tissue sheets 12 may be encased in a liquid impermeable film 28. Alternatively, the compartment 18 may be lined with the film 28. The premoistened tissue sheets 12 may be provided in a refill package or cartridge that may be placed into the compartment 18, the refill package including the liquid impermeable film 28.

In an alternative embodiment, the premoistened tissue sheet compartment 18 may be separable from the dry tissue sheet compartment 20. With this embodiment, when the tissue sheets from either compartment are depleted, the respective compartment may be separated from the other compartment, disposed of, and substituted with a full compartment. Any manner of engagement mechanism may be utilized to removably secure the two compartments together. For example, in the illustrated embodiment, a flange area 34 defined around a bottom circumference of the premoistened tissue sheet compartment 18 defines a skirted flanged receiving area into which a circumferentially extending portion 44 of the dry tissue sheet compartment 20 is pushed and frictionally engaged. To separate or release the compartments, the compartments 18 and 20 are simply pulled apart in the longitudinal direction. It should be appreciated that the engagement mechanism illustrated in FIG. 3 is but one of any suitable type of releasable engaging mechanism that may be used in accordance with the invention.

Referring still to FIG. 3, in an embodiment wherein the compartments 18 and 20 are separable, the dry tissue sheet compartment may contain an open top side 45. With this configuration, a refill stack of the dry tissue sheets 14 may be inserted into the compartment 20 merely by separating the compartment from the premoistened tissue sheet compartment 18 and dropping the refill stack of sheets 14 into the compartment 20. In an alternative embodiment, the compartment 20 may include a resealable lid such that the compartment 20 is an essentially self-contained and enclosed compartment, but has the capability of being opened and refilled.

Figure 4:
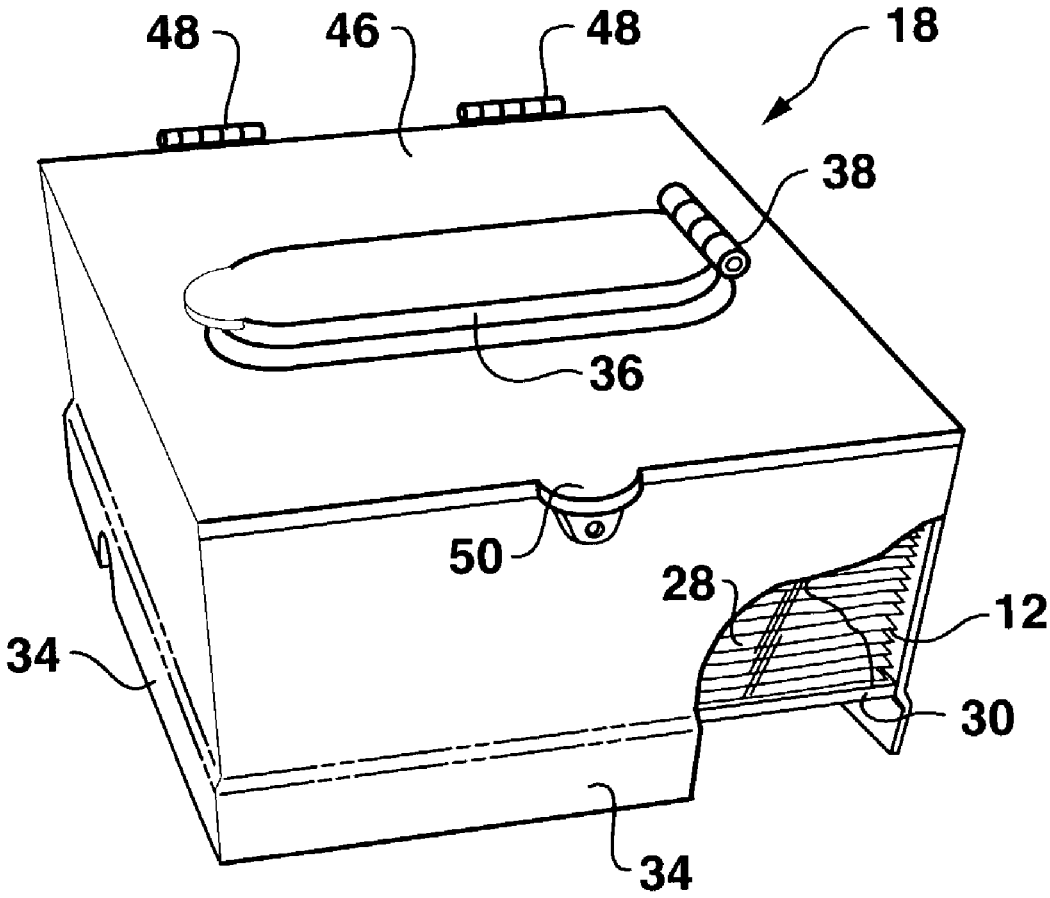
FIG. 4 is a perspective view of a premoistened tissue sheet compartment that may be used as a component of a dispenser in accordance with the invention.

In still an alternate embodiment, it may be desired that each of the compartments 18 and 20 are refillable. In this configuration, each compartment would have a resealable wall, lid, or other member that may be opened to allow a refill cartridge of tissues to be inserted into the respective compartment. An embodiment of a refillable premoistened tissue sheet compartment 18 is illustrated in FIG. 4. In this embodiment, the compartment 18 is provided with a top lid 46 that is hinged to the compartment 18 by hinges 48. The hinges 48 may be, for example, living-hinges. A releasable latch or other suitable mechanism 50 is provided for securing the lid 46. Once the premoistened tissue sheets 12 are depleted, the lid 46 may be lifted and a refill cartridge of tissue sheets 12 simply dropped into the compartment.

It may further be desired that the premoistened tissue sheet compartment 18 include a resealable cover 36 disposed over the dispensing opening 22. The cover 36 serves to maintain the moisture conditions within the compartment 18 and prevents undesired drying out of the tissue sheets 12. In an illustrated embodiment, the lid 36 is simply frictionally engaged with a rim disposed about the dispensing opening 22. Such closure members are well known from their use with conventional premoistened wipe containers.

It should be appreciated by those skilled in the art that the dispenser 10 according to the invention may take on any configuration of housing 16, and that the rectangular type configuration illustrated in the figures is for illustrative purposes only. It should also be appreciated that the compartments 18 and 20 need not be in a stacked configuration, but may take on any suitable arrangement, including a side-by-side arrangement, coaxial arrangement, etc. There are any number of configurations of a housing according to the invention wherein separate compartments are provided for simultaneously dispensing dry and premoistened tissue sheets from a single housing, the housing being supportable by a roll product dispenser fixture. All such configurations are within the scope and spirit of the invention.

Accordingly, it should readily apparent that modifications and variations can be made to the embodiments of the dispenser described herein without departing from the scope and spirit of the invention as set forth in the appended claims.

What is claimed is:

1. A dispenser for storing and dispensing premoistened tissue sheets and dry tissue sheets, said dispenser comprising:

a housing, said housing having a first compartment configured to retain a supply of dry tissue sheets, and a second liquid impermeable compartment configured to retain a supply of premoistened tissue sheets;

a dispensing opening defined in each of said first and second compartments;

a support mechanism disposed on an exterior surface of said housing, said support mechanism engageable with a dispenser fixture such that said housing is supported by a single fixture and consumers are presented with premoistened and dry tissue sheets from a single said housing supported from a single fixture; and wherein said first compartment is separable from said second compartment.

2. The dispenser as in claim 1, wherein the premoistened tissue sheets and dry tissue sheets are individual interfolded sheets, said first compartment and second compartment having a size and configuration for retaining a stack of said respective interfolded sheets.

3. The dispenser as in claim 1, wherein said first and second compartments are in a stacked configuration.

4. The dispenser as in claim 1, wherein said first and second compartments are overlapping along at least a portion thereof and are frictionally engaged along said overlapping portions.

5. The dispenser as in claim 4, wherein one of said first and second compartments comprises a flanged area that overlaps the other of said second and first compartment.

6. The dispenser as in claim 1, wherein at least one of said first and second compartments is openable for refilling said compartment.

7. The dispenser as in claim 6, wherein both of said first and second compartments are openable for refilling said compartments.

8. The dispenser as in claim 1, wherein said dispenser is designed to be supported by a fixture having support arms extending transversely from a generally vertical support surface, said support mechanism comprising protruding members disposed on opposite sides of said housing, said protruding members having a size and shape so as to engage within recesses defined in the fixture support arms.

9. The dispenser as in claim 8, wherein the fixture is a rolled tissue product fixture.

10. The dispenser as in claim 8, wherein said protruding members are spring loaded.

11. The dispenser as in claim 10, wherein said protruding members comprise adapters attachable to said opposite sides of said housing.

12. The dispenser as in claim 8, wherein said protruding members are formed integral with said housing sides.

13. The dispenser as in claim 1, wherein said second compartment is disposed above said first compartment, said dispensing opening in said second compartment defined in a top surface of said housing.

14. The dispenser as in claim 13, wherein said dispensing opening in said first compartment is defined in a bottom surface of said housing.

15. A dispenser for storing and dispensing interfolded stacked premoistened tissue sheets and dry tissue sheets, said dispenser comprising:

a housing, said housing having a width dimension between side walls such that said housing fits between support arms of a mounted rolled product fixture;

a generally liquid impermeable premoistened tissue sheet compartment defined in said housing;

a dry tissue sheet compartment defined in said housing below said premoistened tissue sheet compartment;

a dispensing opening defined in said premoistened tissue sheet compartment through a top surface of said housing;

a dispensing opening defined in said dry tissue sheet compartment through a bottom surface of said housing;

protruding engagement members provided said housing side walls and configured to engage in complimentary recesses provided in the support arms of the rolled product fixture;

wherein said premoistened tissue sheet compartment and said dry tissue sheet compartment are formed of the same material; and wherein said premoistened tissue sheet compartment is lined with a liquid impermeable material that substantially encloses the premoistened tissue sheets except for essentially a single sheet exposed by an opening in said impermeable material aligned with said dispensing opening in said premoistened tissue sheet compartment.

16. The dispenser as in claim 15, further comprising a resealable cover disposed over said dispensing opening in said premoistened tissue sheet compartment.

17. The dispenser as in claim 15, wherein said premoistened tissue sheet compartment and said dry tissue sheet compartment are formed of the same material.

18. The dispenser as in claim 17, wherein said housing is an integral component, said premoistened tissue sheet compartment and said dry tissue sheet compartment sharing a common wall within said housing.

19. The dispenser as in claim 18, wherein said common wall defines a top of said dry tissue sheet compartment and a bottom of said premoistened tissue sheet compartment.

20. A dispenser for storing and dispensing interfolded stacked premoistened tissue sheets and dry tissue sheets, said dispenser comprising:

a housing, said housing having a width dimension between side walls such that said housing fits between support arms of a mounted rolled product fixture;

a generally liquid impermeable premoistened tissue sheet compartment defined in said housing;

a dry tissue sheet compartment defined in said housing below said premoistened tissue sheet compartment;

a dispensing opening defined in said premoistened tissue sheet compartment through a top surface of said housing;

a dispensing opening defined in said dry tissue sheet compartment through a bottom surface of said housing;

protruding engagement members provided said housing side walls and configured to engage in complimentary recesses provided in the support arms of the rolled product fixture; and wherein said premoistened tissue sheet compartment is separable from said dry tissue sheet compartment.

21. The dispenser as in claim 20, wherein said dry tissue sheet compartment is press fitted into a flanged area disposed below said premoistened tissue sheet compartment.

22. The dispenser as in claim 21, wherein said premoistened tissue sheet compartment is a closed compartment and said dry tissue sheet compartment comprises an open top end such that when said compartments are combined, a bottom surface of said premoistened tissue sheet compartment defined a top of said dry tissue sheet compartment.

* * * * *